US005625904A

United States Patent [19]

Kline

[11] Patent Number: 5,625,904

[45] Date of Patent: May 6, 1997

[54] SOCK WITH POCKET

[76] Inventor: Kimberly A. Kline, 7423 Courtland Cir., Manassas, Va. 22111

[21] Appl. No.: 556,851

[22] Filed: Nov. 2, 1995

[51] Int. Cl.[6] ..... A41B 11/00

[52] U.S. Cl. ..... 2/239; 2/409; 2/252

[58] Field of Search ..... 2/239, 1, 94, 247, 2/249, 250, 251, 252, 253, 254, 908, 912, 919, 409

[56] References Cited

U.S. PATENT DOCUMENTS

| | | | |
|---|---|---|---|
| 1,117,591 | 11/1914 | Morningstar | 2/239 |
| 1,128,941 | 2/1915 | Brown | 2/247 X |
| 1,224,842 | 5/1917 | Boyd | 2/252 |
| 4,005,494 | 2/1977 | Burn | 2/239 |
| 4,445,233 | 5/1984 | Rubin | 2/247 |
| 4,961,235 | 10/1990 | Williger | 2/247 |
| 5,133,091 | 7/1992 | del Valle Mas | 2/252 |

*Primary Examiner*—C. D. Crowder
*Assistant Examiner*—Gloria Hale
*Attorney, Agent, or Firm*—John K. Donaghy

[57] ABSTRACT

A sock is provided with a pocket comprising an outer pocket wall having an extension forming a flap. A slot opening in the sock receives the flap which is fastened to the inside of the sock leg.

8 Claims, 2 Drawing Sheets

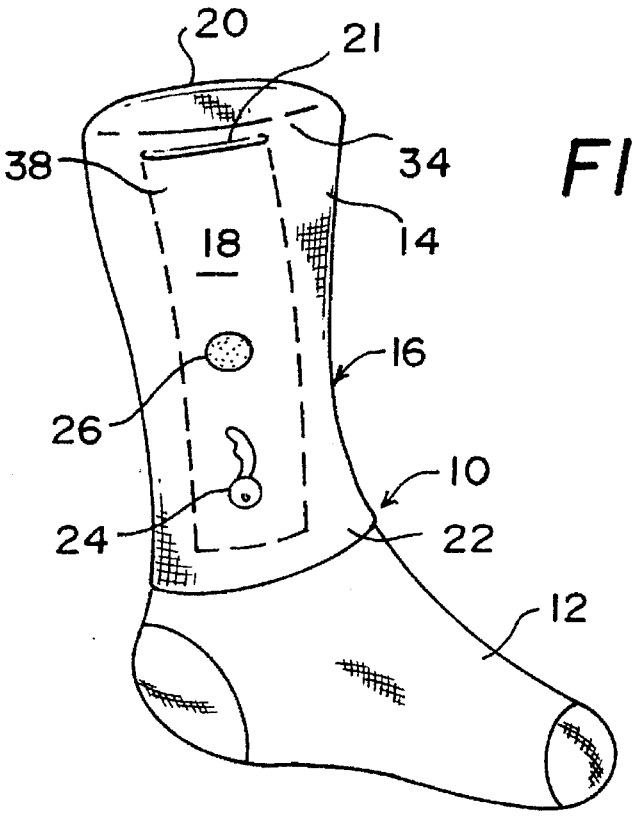
FIG. 1
FIG. 6
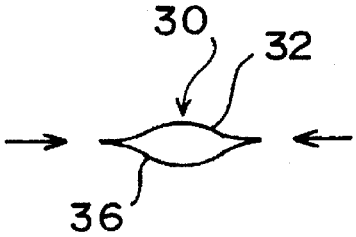
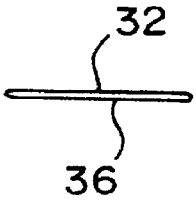
FIG. 7
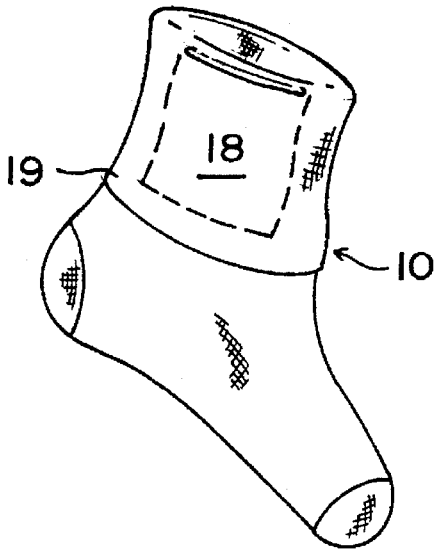
FIG. 2

SOCK WITH POCKET

BACKGROUND OF THE INVENTION

1. Field of the Invention

This invention pertains to socks and specifically to socks having pockets and flap closure therefore for use by sports persons who may wish to store keys and money while jogging or the like.

2. Background of the Prior Art

The prior art discloses pockets on socks. Representative of such structures is shown in U.S. Pat. No. 2,890,461. Pocket 11 is shown in the inside of sock 10 and a closure flap 19 has a snap 22. U.S. Pat. No. 4,038,694 shows a pocket 17 on sock 11. U.S. Pat. No. 4,961,235 discloses a pocket with flap closure 11 and U.S. Pat. No. 5,133,091 shows a pocket 12 on sock 10.

These devices have serious short comings in that their construction is complicated and expensive.

SUMMARY OF THE INVENTION

There is a need for sock with a pocket for holding such things as keys, money and the like.

It is one object of this invention to provide a well constructed sock with a waterproof pocket for use by joggers, cyclysts or the like.

It is another object to provide a pocket on a sock which is easy and inexpensive to produce.

It is another object of this invention to provide a sock with a pocket and a unique closure whereby objects will not escape during jogging, running or the like.

These and other objects of the invention will become apparent to those skilled in the art to which the invention pertains from a reading of the following specifications when taken with the annexed drawings.

BRIEF DESCRIPTION OF THE DRAWINGS

FIG. 1 is a side view of a sock with a pocket in the inside thereof.

FIG. 2 is a side view of a sock with a pocket in the inside rolled down portion.

FIG. 6 is a top view of a spring-like fastener in open position.

FIG. 7 is a top view of the spring-like fastener in closed position.

DETAILED DESCRIPTION OF THE PREFERRED EMBODIMENT OF THE INVENTION

Figure 3:
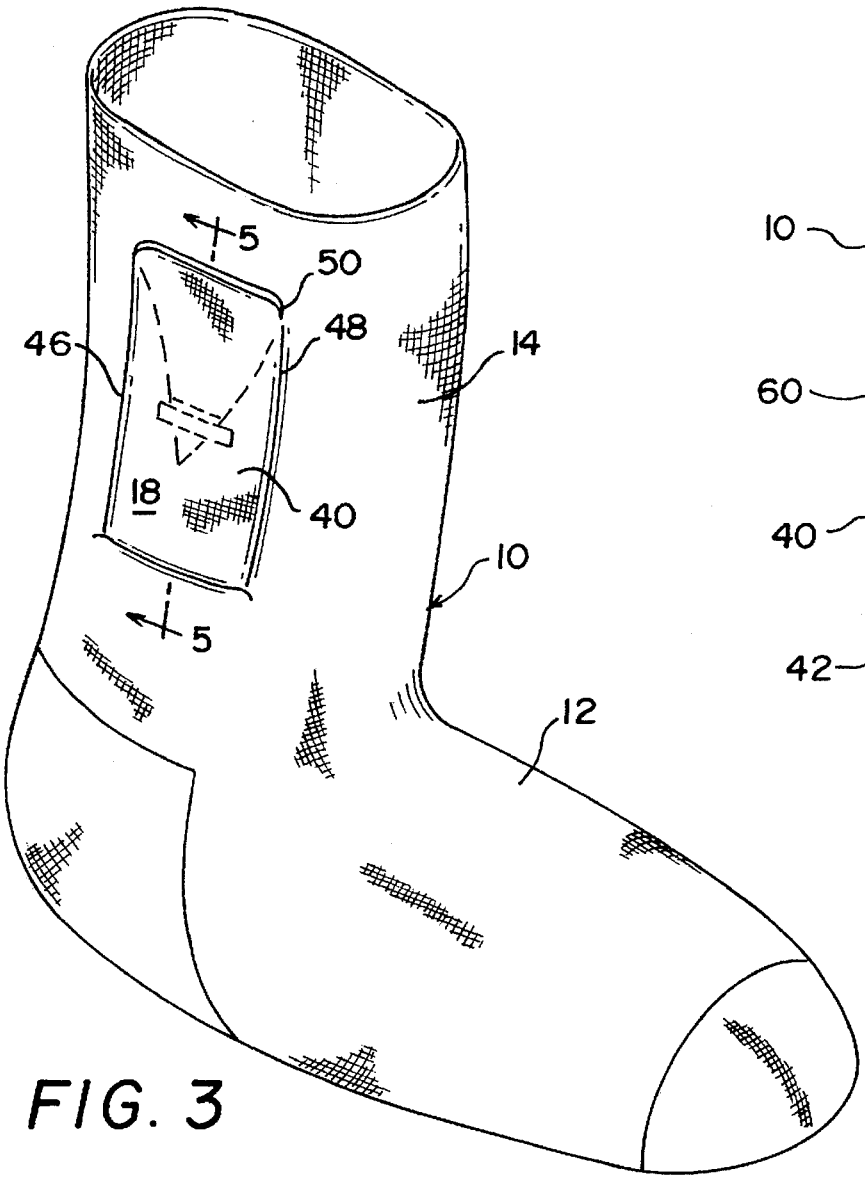
FIG. 3 is a perspective view of a sock with a pocket and closure.

Referring now in more detail to the drawings, FIGS. 1 and 2 show a sock 10 having a foot portion 12 and a leg portion 14. The leg portion 14 is a mid calf tubular member with a tightened middle section 16.

The leg portion 14 has a pocket 18 on the inside of the sock and extends from near the top 20 to approximately the ankle area 22. A closure 21 such as hook and eye is provided to prevent escape of objects such as keys, coins, etc.

The closure, may be of the flexible plastic or steel band type 30, FIG. 6. One portion 32 is woven into the sock section 34 and the other portion 36 is enclosed in the pocket top edge 38. Pressure on the steel/plastic number 30 in the direction of the arrows will operate to open the closure 30 as shown. Release of the closure 30 will cause the members 32–36 to return to a flattened state as in FIG. 7.

FIG. 2 shows an ankle sock 10 with the pocket 18 on the inside of a rolled down portion 19. A similar closure as described above is contemplated.

FIG. 3 shows the sock 10 with foot section 14 and leg section 14. The pocket 18 comprises an outer wall portion 40 sewn at a bottom edge 42 to the wall 44 of the sock 10. The portion 40 is stitched vertically on sides 46 and 48 to top edge 50. It is seen that the outer portion 40 sewn at 42, 46 and 48 together with leg portion 44 define a pocket chamber 60, FIG. 5 having an entrance 62, FIG. 4.

Figure 4:
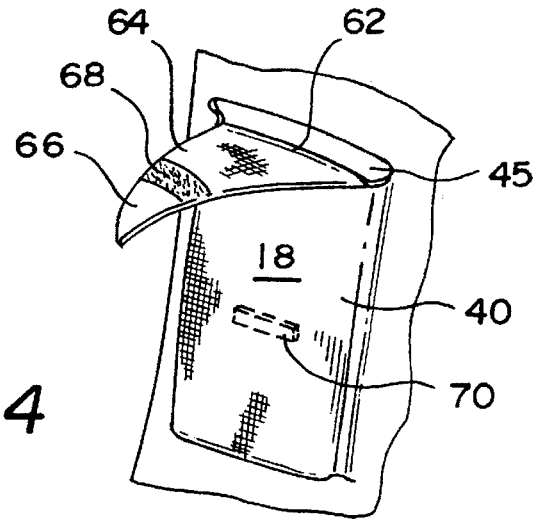
FIG. 4 is a side view of the sock pocket flap closure.

The outer portion 40 of the pocket 18 has an extension panel 64, FIG. 4 in the shape of a triangle, having a tip section 66. The tip section 66 has a fastener member 68 such as hook and eye devices.

Figure 5:
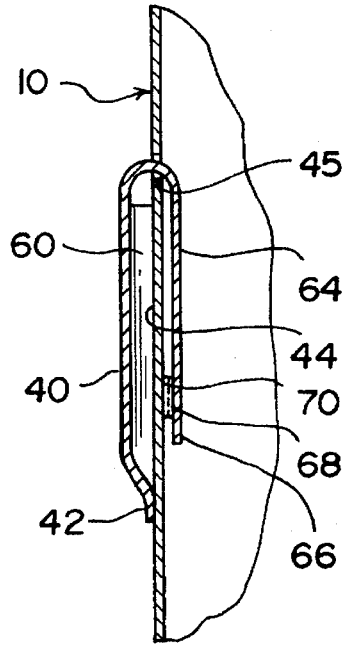
FIG. 5 is a sectional side view of the sock with closure flap and fastener.

The sock wall 44 has an opening 45 in the form of a slot extending the width of the portion 40 at the edge 50, FIG. 3. The extension or flap 64, leading with tip 66, is inserted through the slot opening 45 and pulled downwardly inside the sock as shown in FIG. 5. The fastener 68 is attached to a complementary fastener 70, FIG. 4, which may be a strip of material sewn to the inside of the sock wall or it may be an adhesive sewn into the sock wall.

The outer wall portion 40 and its extension 64 may be the water proof material. Thus, the contents of the pocket will remain dry in the event of rain, etc.

It will be seen that the pocket 18 and the unique closure 64 provide a double fastening means. One is in the fasteners 68–70 and the other is by reason of the wearer's leg pressing the flap 64 against the inside of the sock. Thus, objects such as keys or coins bouncing up and down in the pocket will not loosen or otherwise undo the flap 64 when secured inside the sock, FIG. 5.

It will be understood that the pocket 18, FIGS. 3–5, may be constructed such that the pocket is inside the sock. The flap 64 would extend through slot 45 to the outside and be fastened to the outer wall 44 of the sock. The fastener 70 would be on the outer wall opposite to its present location.

While the inventor has been described with regard to a particular embodiment thereof, it will be apparent to those, skilled in the sock art, that numerous changes may be made in the invention without departing from the spirit and scope thereof.

What I claim is:

1. A sock having a pocket comprising:

a sock leg portion having an outer wall and an inner wall:

a panel portion secured to the leg portion;

said panel having an extension portion;

a pocket chamber defined by the leg portion and the panel portion;

an opening in the leg portion adjacent to the pocket chamber; and said extension portion threaded through the opening and extended downwardly adjacent to the inner wall of the leg portion.

2. A sock according to claim 1, wherein:

said extension portion is a flap threaded through the opening and laid adjacent the inside wall of the leg portion.

3. A sock according to claim 1, wherein:

said extension portion is a triangular flap having a tip portion for threading through the opening and laid adjacent to the leg portion.

4. A sock according to claim 1, wherein:

said extension portion has a fastener and said leg portion has a corresponding fastener whereby the extension portion is secured to the leg portion.

5. A sock according to claim 3, wherein:

said tip portion has fastener means and said leg portion has fastener means whereby said tip portion is held to said leg portion.

6. A according to claim 5, wherein:

said fastener means is hook and eye means.

7. A according to claim 5, wherein:

said fastener means is adhesive means.

8. A according to claim 5, wherein:

said fastener means is spring means.

* * * * *